US006418649B1

(12) United States Patent
Bolon

(10) Patent No.: US 6,418,649 B1
(45) Date of Patent: Jul. 16, 2002

(54) SYSTEM FOR THE INSCRIPTION AND SECURE RECORDATION OF INFORMATION

(76) Inventor: Judith Bolon, 121 N. Balsamina, Portola Valley, CA (US) 94028

( * ) Notice: Subject to any disclaimer, the term of this patent is extended or adjusted under 35 U.S.C. 154(b) by 3 days.

(21) Appl. No.: 09/629,730

(22) Filed: Jul. 31, 2000

Related U.S. Application Data

(63) Continuation-in-part of application No. 08/999,982, filed on Jun. 20, 1997, now Pat. No. 6,161,316.

(51) Int. Cl.[7] ..... B52F 21/00
(52) U.S. Cl. ..... 40/360; 428/41.8
(58) Field of Search ..... 40/360, 591, 594; 428/42.2, 42.3, 43, 41.8, 916, 914; D19/1; 462/66, 8, 18; 283/81

(56) References Cited

U.S. PATENT DOCUMENTS

| | | | | | |
|---|---|---|---|---|---|
| 1,104,310 | A | | 7/1914 | Price | |
| 1,393,213 | A | | 10/1921 | Gilbert | |
| 1,637,156 | A | | 7/1927 | Mirski | |
| 3,620,553 | A | | 11/1971 | Donovan | |
| 4,109,047 | A | * | 8/1978 | Fredrickson | 428/916 X |
| 4,352,855 | A | * | 10/1982 | Hiraishi et al. | 428/914 X |
| 4,925,716 | A | * | 5/1990 | Haas | 428/42.2 |
| 4,940,690 | A | * | 7/1990 | Skees | 428/41.8 X |
| 5,090,942 | A | * | 2/1992 | Traise | 428/41.8 X |
| 5,135,437 | A | * | 8/1992 | Schubert | 462/8 |
| 5,487,568 | A | * | 1/1996 | Ipsen | 283/81 |
| 6,161,316 | A | * | 12/2000 | Bolon | 40/360 |
| 6,280,322 | B1 | * | 8/2001 | Linden et al. | 462/18 |

* cited by examiner

*Primary Examiner*—Jack Lavinder
*Assistant Examiner*—Melanie Torres
(74) *Attorney, Agent, or Firm*—Stevens, Davis, Miller; Miller & Mosher, LLP

(57) ABSTRACT

A system for the inscription and secure recordation of information includes (a) an inscription page for receiving an inscription, the inscription page including (i) a front side and a back side, the back side having an adhesive coating thereon, and (ii) a plurality of detachable inscription sections; (b) a carbonless privacy page, the privacy page including (i) a privacy section and (ii) opposed privacy attaching sections; and (c) a carbonless recordation page for recording the inscription, the recordation page including (i) a recordation section and (ii) opposed recordation attaching sections. The inscription page is removably attached by the adhesive coating to the privacy section, and the opposed privacy attaching sections, and the opposed privacy attaching sections, are removably attached to a corresponding one of the opposed recordation attaching sections.

19 Claims, 2 Drawing Sheets

SYSTEM FOR THE INSCRIPTION AND SECURE RECORDATION OF INFORMATION

This is a continuation-in-part application of U.S. patent application Ser. No. 08/999,982 filed Jun. 20, 1997 now U.S. Pat. No. 6,161,316, incorporated herein by reference.

BACKGROUND OF THE INVENTION

1. Field of the Invention

This invention relates generally to a system for the inscription and secure recordation of information, and a method of inscribing and securely recording information by means of the aforementioned system. The invention relates more specifically to a system which not only facilitates the inscription of an adhesive label, but which ensures that the inscription is recorded in a secure manner.

2. Description of Related Art

Conventional devices for recording an inscription by mechanical transfer are known. Such devices, however, do not necessarily ensure the security of the inscription. For example, U.S. Pat. No. 1,104,310 discloses a "collection-draft sheet" having three pages: an original page, a "privacy page," and a log page. The privacy page, which serves to transfer the entry on the original sheet to the log page, is a sheet of carbon paper. The carbon sheet, however, is not an integral part of the collection-draft sheet. While the original and log pages are bound in a book, it is necessary to insert a separate carbon sheet between the original and log pages each time that an entry is to be made. Because it is a separate, inserted, sheet, the carbon sheet does not ensure the security of the inscription transferred to the log page.

Devices are also known for providing adhesive labels or cards. For example, U.S. Pat. No. 5,630,627 describes a business form which includes a removable laminate card produced by adhering a transparent piece of plastic and a layer of backing material to the imprinted back of the form and by die cutting completely through the form and transparent piece of plastic to form a card laminate which is peelable from the layer of backing material and from the business form. Similarly, U.S. Pat. No. 5,637,369 describes a business form which includes a card produced by adhering conventional label stock to the back of the form, by die cutting completely through the form and partially through the label stock to produce a laminate which can be peeled from the business form, and by peeling the laminate from the business form and folding the laminate to form the card. While such devices provide for removable labels or cards, they have no inscription security feature.

None of the aforementioned conventional devices, therefore, provides a system which not only facilitates the inscription of an adhesive label, but ensures that the inscription is recorded in a secure manner, thus satisfying a long-felt need in this environment.

SUMMARY OF THE INVENTION

It is an object of the present invention to provide a system for the inscription and secure recordation of information, and a method of inscribing and securely recording information by means of the aforementioned system. It is a further object to provide a system which not only facilitates the inscription of an adhesive label, such as might be used as a name badge, but which ensures that the inscription is recorded in a secure manner.

Accordingly, in a first preferred embodiment the present invention advantageously relates to a system comprising (a) an inscription page for receiving an inscription, the inscription page comprising (i) a front side and a back side, the back side having an adhesive coating thereon, and (ii) a plurality of detachable inscription sections; (b) a carbonless privacy page, the privacy page comprising (i) a privacy section and (ii) at least first and second opposed privacy attaching sections; and (c) a carbonless recordation page for recording the inscription, the recordation page comprising (i) a recordation section and (ii) at least first and second opposed recordation attaching sections. The inscription page is removably attached by the adhesive coating to the privacy section, and the at least first and second opposed privacy attaching sections, and the at least first and second opposed privacy attaching sections, are removably attached to a corresponding one of the at least first and second opposed recordation attaching sections.

The invention further relates to a method of using the aforementioned system. The method comprises the steps of (a) inscribing one or a plurality of the detachable inscription sections; (b) detaching the one or a plurality of inscribed detachable inscription sections; and (c) detaching the recordation section from first recordation attaching section and from the second recordation attaching section so as to provide a record of each inscription.

As an example of the method of inscribing and securely recording information by means of the aforementioned system, a visitor would make an inscription in one of the detachable inscription sections on the inscription page. Each badge is defined by incisions so as to facilitate its removal by peeling. By virtue of the adhesive coating, the badge can then be attached to another surface, such as, for example, to the apparel of the visitor. By the application of mechanical pressure (i.e., as a result of making the inscription), the inscription is transferred from the inscription page through the carbonless privacy page to the carbonless recordation page.

Because the privacy page and the recordation page are removably attached to one another, the presence of the privacy page ensures that the inscriptions which have been transferred to the recordation page remain unseen by a visitor making a subsequent inscription. That is, the privacy page ensures that the inscription on the recordation page is not visible to subsequent inscriber through the open space which remains in the inscription page once a badge has been removed. Absent the destruction of the removable attachments formed by the privacy attaching sections and the recordation attaching sections, any unauthorized reader is denied the knowledge of the entries on the recordation page. Once the supply of badges on the inscription page has been depleted (or before, if desirable), the recordation section can be detached from the first recordation attaching section and the second recordation attaching section so as to provide a record of each inscription.

The present invention, therefore, provides a system which by virtue of its design and construction advantageously allows entries which are inscribed on the inscription page to be replicated on the recordation page, yet to be screened from view by virtue of the presence of the privacy page. The system, therefore, not only facilitates the inscription of an adhesive label, such as might be used as a name badge, but ensures that the inscription is recorded in a secure manner.

BRIEF DESCRIPTION OF THE DRAWINGS

Other objects, features, and advantages of the present invention will become more fully apparent from the following detailed description of the preferred embodiments and the accompanying drawings. As depicted in the attached drawings.

DESCRIPTION OF THE PREFERRED EMBODIMENTS

The present invention will be disclosed in terms of the currently perceived preferred embodiments thereof.

The present invention is directed to an inscription and secure recordation system comprising an inscription page, a mechanical transfer carbonless privacy page, and a mechanical transfer carbonless recordation page. To facilitate the secure recordation of the inscriptions, the privacy page is removably attached to the recordation page.

Figure 2:
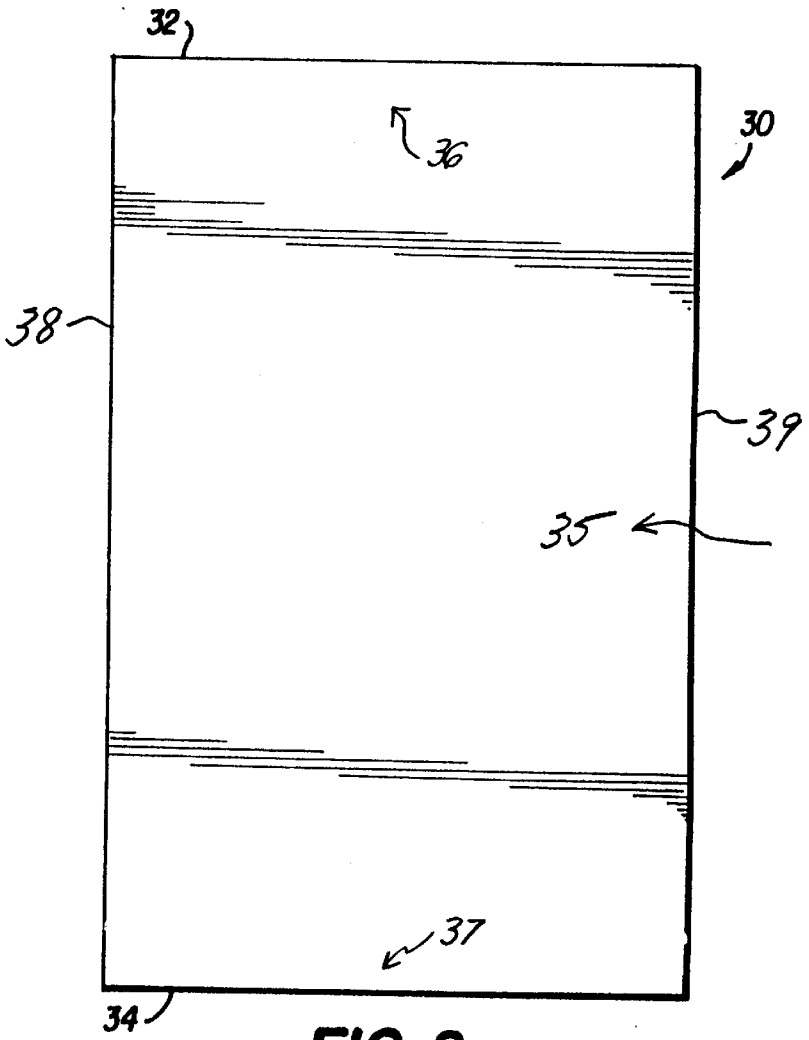
FIG. 2 is a plan view of a carbonless privacy page of the system for the inscription and secure recordation of information.
Figure 1:
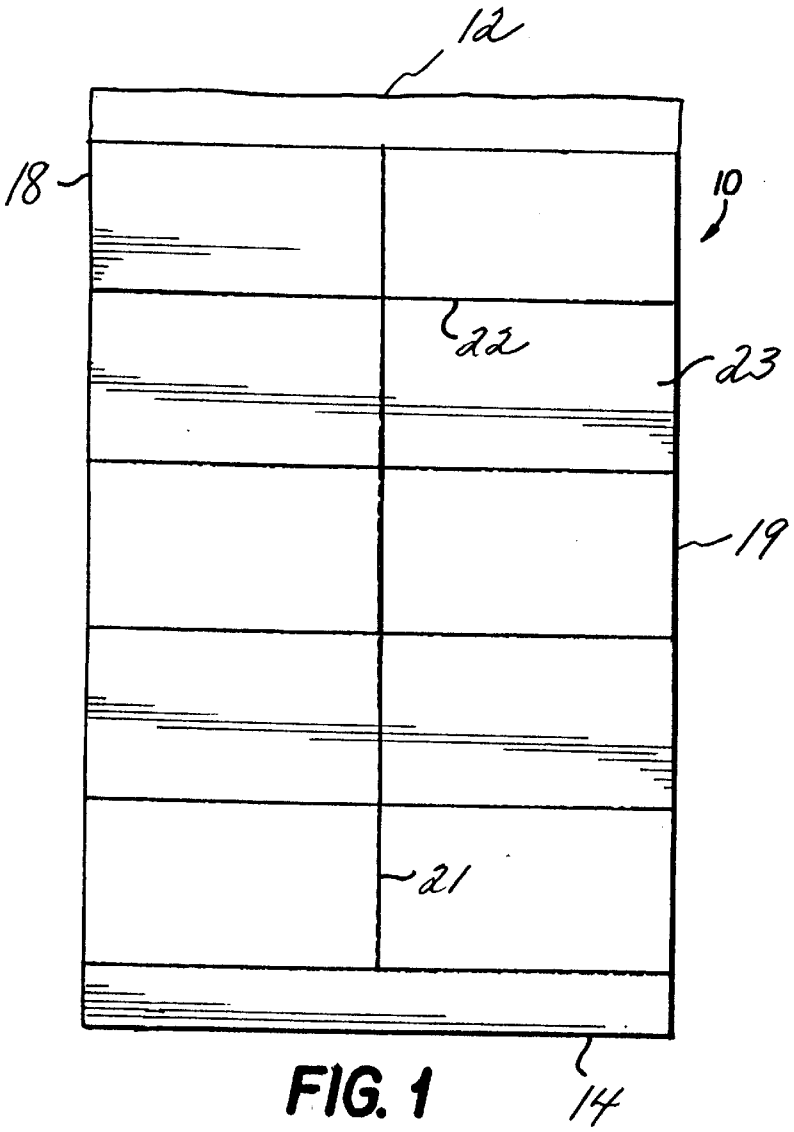
FIG. 1 is a plan view of an inscription page of a system for the inscription and secure recordation of information.
Figure 3:
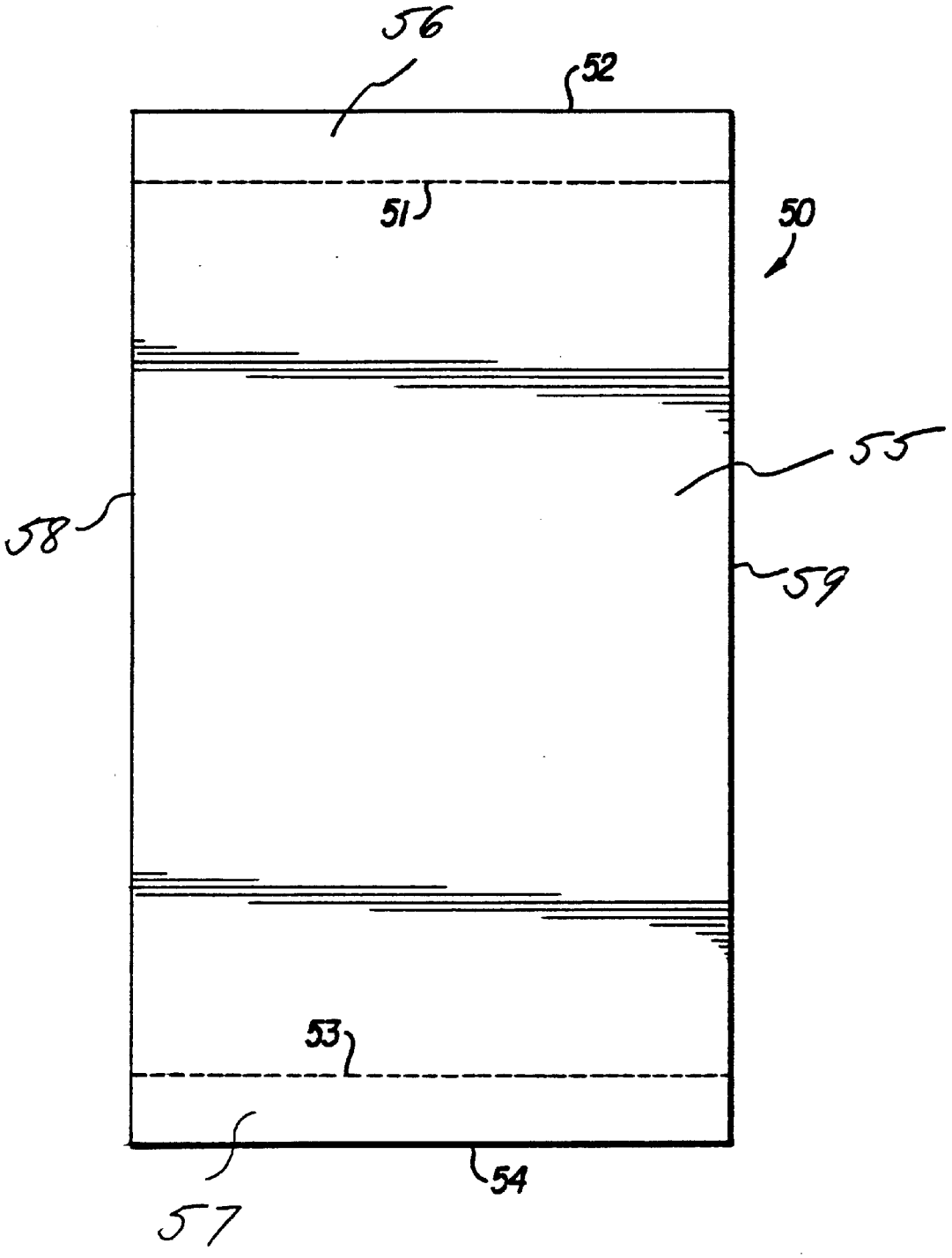
FIG. 3 is a plan view of a carbonless recordation page of the system for the inscription and secure recordation of information.

Referring to FIGS. 1, 2, and 3, a system for the inscription and secure recordation of information constructed in accordance with a first preferred embodiment of the present invention is shown. The system comprises (a) an inscription page 10 for receiving an inscription, the inscription page comprising (i) a front side and a back side, with the back side having an adhesive coating thereon, and (ii) a plurality of detachable inscription sections 23 (see FIG. 1); (b) a carbonless privacy page 30 (see FIG. 2); and (c) a carbonless recordation page 50 for recording the inscription (see FIG. 3).

The privacy page 30 serves at least two functions. First, it provides for the transfer of the inscription made on the inscription page 10 to the recordation page 50. Secondly, it provides for the security of the recorded inscription on recordation page 50.

As depicted in FIG. 2, carbonless privacy page 30 comprises (i) a privacy section 35 and (ii) at least first and second opposed privacy attaching sections 36 and 37.

As depicted in FIG. 3, carbonless recordation page 50 comprises (i) a recordation section 55 and (ii) at least first and second opposed recordation attaching sections 56 and 57.

Inscription page 10 is removably attached by the adhesive coating to privacy section 35 and the at least first and second opposed privacy attaching sections 36 and 37, and the at least first and second opposed privacy attaching sections 36 and 37 are removably attached to a corresponding one of the at least first and second opposed recordation attaching sections 56 and 57.

More specifically, carbonless privacy page 30 comprises (i) a privacy top edge 32, a privacy bottom edge 34, a privacy first side edge 38, and a privacy second side edge 39; (ii) a first privacy attaching section 36 disposed proximate to privacy top edge 32 and extending from privacy first side edge 38 to privacy second side edge 39; (iii) a privacy section 35; and (iv) a second privacy attaching section 37 disposed proximate to privacy bottom edge 34 and extending from privacy first side edge 38 to privacy second side edge 39.

Carbonless recordation page 50 comprises (i) a recordation top edge 52, a recordation bottom edge 54, a recordation first side edge 58, a recordation second side edge 59; (ii) a first recordation attaching section 56 disposed between recordation top edge 52 and a horizontal perforation 51 extending from recordation first side edge 58 to recordation second side edge 59, and located proximate to recordation top edge 52, with first recordation attaching section 56 having a size equal to that of first privacy attaching section 36; (iii) a recordation section 55; and (iv) a second recordation attaching section 57 disposed between recordation bottom edge 54 and a horizontal perforation 53 extending from recordation first side edge 58 to recordation second side edge 59, and located proximate to recordation bottom edge 54, with second recordation attaching section 57 having a size equal to that of second privacy attaching section 37.

Inscription page 10 is removably attached by the adhesive coating to privacy section 35 and the at least first and second opposed privacy attaching sections 36 and 37, with first privacy attaching section 36 being removably attached to first recordation attaching section 56, and second privacy attaching section 37 being removably attached to second recordation attaching section 57.

In a typical embodiment, inscription page 10 comprises (i) an inscription top edge 12, an inscription bottom edge 14, an inscription first side edge 18, and an inscription second side edge 19; (ii) a vertical incision 21 disposed equidistant between inscription first side edge 18 and inscription second side edge 19; and (iii) a plurality of parallel horizontal incisions 22 extending from inscription first side edge 18 to inscription second side edge 19, with vertical incision 21 extending from a horizontal incision most proximate to inscription top edge 12 to a horizontal incision most proximate to inscription bottom edge 14.

Each of the plurality of inscription sections 23 is, for example, a label suitable for use as an identification badge or a name tag.

In an optional embodiment, inscription page 10 comprises not the aforementioned plurality of detachable inscription sections 23, but rather, a single detachable inscription section.

In a typical embodiment, inscription page 10 comprises an 8"×13.75" paper stock with a non-permanent adhesive coating (i.e., such as is capable of facilitating removable attachment) on its back side, with the layout of the inscription page as depicted in FIG. 1. In this embodiment, the individual inscription sections extend to the edges of the page, are directly adjacent to one another (i.e., separated only by the incisions), and have square corners.

Moreover, FIG. 1 shows detachable inscription sections 23 having the same size and shape on a given page. However, in other embodiments, not shown, a given page may have detachable sections of different sizes and/or shapes.

In this typical embodiment, carbonless privacy page 30 (FIG. 2) comprises an 8"×13.75" opaque paper which is capable of mechanically transferring the inscription from inscription page 10 to carbonless recordation page 50. First privacy attaching section 36 and second privacy attaching section 37 are each 8"×0.75".

As shown in FIGS. 1–3, privacy page 30 is a continuous structure or sheet. Preferably, the region of privacy page 30 in contact with inscription sections 23 does not have holes therein. Accordingly, because privacy page 30 is shown as being opaque, the entire inscription transferred to the recordation page 50 behind the opaque privacy page is screened from view.

In this typical embodiment, carbonless recordation page 50 comprises an 8"×13.75" mechanical transfer paper. First recordation attaching section 56 and second recordation attaching section 57 are each 8"×0.75". That is, horizontal perforation 51 is inset 0.75" from recordation top edge 52, and horizontal perforation 53 is inset 0.75" from recordation bottom edge 54.

In an optional embodiment of the inscription page 10 layout, the individual inscription sections are inset from the edges of the page, are horizontally adjacent to one another, but separated by a vertical space, and have rounded corners. In this embodiment, inscription page 10 comprises an 8"×13.75" paper stock with a non-permanent adhesive coating (i.e., for removable attachment) on its back side. The inscription page is inscribed (e.g., die-cut) into ten 3.5"× 2.25" inscription sections 23. The left edge of the die-cut is inset 0.33" from inscription first side edge 18, and the right edge of the die-cut is inset 0.33" from inscription second side edge 19. A 0.33" vertically-oriented space at the center of the page divides the page into two vertically-oriented columns of inscription sections (five inscription sections in each of the two columns). A 1.25" margin separates inscription top edge 12 from the top die cut edge (i.e., from the incision at the top of each of the first inscription sections in each of the two columns of inscription sections), and a 1.25" margin separates inscription bottom edge 14 from the bottom die cut edge (i.e., from the incision at the bottom of each of the fifth inscription sections in each of the two columns of inscription sections). Each of the inscription sections can optionally include preprinting.

The invention further relates to a method of inscribing and securely recording information by means of the aforementioned system. The method comprises the steps of (a) inscribing one or a plurality of the detachable inscription sections 23; (b) detaching the one or a plurality of inscribed detachable inscription sections; and (c) detaching recordation section 55 from first recordation attaching section 56 and from second recordation attaching section 57 so as to provide a record of each inscription.

As an example of the method of inscribing and securely recording information by means of the aforementioned system, a visitor would make an inscription in one of the detachable inscription sections 23 (e.g., a security badge) on inscription page 10 (FIG. 1). Each badge is defined by incisions so as to facilitate its removal by peeling. By virtue of the adhesive coating, the badge can then be attached to another surface, such as, for example to the apparel of the visitor. By the application of mechanical pressure (i.e., as a result of making the inscription), the inscription is transferred from inscription page 10 through carbonless privacy page 30 to carbonless recordation page 50.

Because the privacy page and the recordation page are removably attached to one another, the presence of the privacy page ensures that the inscriptions which have been transferred to the recordation page remain unseen by a visitor making a subsequent inscription. That is, the privacy page ensures that the inscription on the recordation page is not visible to subsequent inscriber through the open space which remains in the inscription page once a badge has been peeled. Absent the destruction of the removable attachments formed by the privacy attaching sections and the recordation attaching sections, any unauthorized reader is denied the knowledge of the entries on the recordation page. Once the supply of badges on the inscription page has been depleted (or before, if desirable), the recordation section can be detached from the first recordation attaching section and the second recordation attaching section so as to provide a record of each inscription.

The present invention, therefore, provides a system which by virtue of its design and construction advantageously allows entries which are inscribed on the inscription page to be replicated on the recordation page, yet to be screened from view by virtue of the presence of the privacy page. The system, therefore, not only facilitates the inscription of an adhesive label, such as might be used as a name badge, but ensures that the inscription is recorded in a secure manner.

While only certain preferred embodiments of this invention have been shown and described by way of illustration, many modifications will occur to those skilled in the art. For example, while the system has been described in the context of a security badge application, it is equally applicable to any service which requires the inscription and secure recordation of information.

By way of further example of modifications within the scope of this invention, while the layout of the inscription page has been described in a first embodiment as comprising square cornered detachable inscription sections, and in a second embodiment as comprising detachable inscription sections with rounded corners, other embodiments of the detachable inscription sections could comprise any other configuration capable of being accommodated by the inscription page.

By way of further example of modifications within the scope of this invention, while the inscription page, privacy page, and recordation page have been depicted in FIG. 1, FIG. 2, and FIG. 3, respectively, as being rectangular in shape, other embodiments could comprise, depending upon the particular service, any other configuration (e.g., circular or polygonal) capable of providing for the inscription and secure recordation of information.

Furthermore, while the inscription page and the detachable inscription sections, the privacy page, and the recordation page have been exemplified herein as having certain dimensions, other embodiments of the inscription page and the detachable inscription sections, the privacy page, and the recordation page could have different dimensions, provided that the dimensions thereof can provide the required inscription and secure recordation of information.

It is, therefore, desired that it be understood that it is intended herein to cover all such modifications that fall within the true spirit and scope of this invention.

What is claimed is:

1. A system for the inscription and secure recordation of information comprising:

(a) an inscription page for receiving an inscription, said inscription page comprising (i) a front side and a back side, said back side having an adhesive coating thereon, and (ii) a plurality of detachable inscription sections;

(b) an opaque carbonless privacy page; and (c) a carbonless recordation page having a front side and a back side for recording said inscription on said recordation page, said privacy page providing for the transfer of said inscription from the inscription page to the front side of said recordation page, and providing for the security of said recorded inscription, such that said front side of said recordation page, including said recorded inscription entirely, is not visible when one of said plurality of detachable inscription sections is removed.

2. A system according to claim 1, wherein said privacy page has no holes therein.

3. A system for the inscription and secure recordation of information comprising:

(a) an inscription page for receiving an inscription, said inscription page comprising (i) a front side and a back side, said back side having an adhesive coating thereon, and (ii) a plurality of detachable inscription sections;

(b) a carbonless privacy page comprising (i) a privacy top edge, a privacy bottom edge, a privacy first side edge, and a privacy second side edge; (ii) a first privacy attaching section disposed proximate to said privacy top edge and extending from said privacy first side edge to said privacy second side edge; (iii) a privacy section; and (iv) a second privacy attaching section disposed proximate to said privacy bottom edge and extending from said privacy first side edge to said privacy second side edge; and (c) a carbonless recordation page comprising (i) a recordation top edge, a recordation bottom edge, a recordation first side edge, a recordation second side edge; (ii) a first recordation attaching section disposed between a recordation top edge and a horizontal perforation extending from said recordation first side edge to said recordation second side edge and located proximate to said recordation top edge, said first recordation attaching section having a size equal to that of said first privacy attaching section; (iii) a recordation section; and (iv) a second recordation attaching section disposed between a recordation bottom edge and a horizontal perforation extending from said recordation first side edge to said recordation second side edge and located proximate to said recordation bottom edge, said second recordation attaching section having a size equal to that of said second privacy attaching section;

said inscription page being removably attached by said adhesive coating to said privacy section and said at least first and second opposed privacy attaching sections, said first privacy attaching section being removably attached to said first recordation attaching section, and said second privacy attaching section being removably attached to said second recordation attaching section.

4. A system according to claim 3, wherein said inscription page comprises (i) an inscription top edge, an inscription bottom edge, an inscription first side edge, and an inscription second side edge; (ii) a vertical incision disposed equidistant between said inscription first side edge and said inscription second side edge; and (iii) a plurality of parallel horizontal incisions extending from said inscription first side edge to said inscription second side edge, said vertical incision extending from a horizontal incision most proximate to said inscription top edge to a horizontal incision most proximate to said inscription bottom edge.

5. A system according to claim 3, wherein any of said plurality of inscription sections is an identification badge.

6. A system of claim 3, wherein said privacy page functions to hide said recordation page including said recorded inscription thereon when one of said plurality of detachable inscription sections is detached.

7. A system for the inscription and secure recordation of information comprising:

(a) an inscription page for receiving an inscription, said inscription page comprising (i) a front side and a back side, said back side having an adhesive coating thereon, and (ii) one or a plurality of detachable inscription sections;

(b) a carbonless privacy page, said privacy page comprising (i) a privacy section and (ii) at least first and second opposed privacy attaching sections; and (c) a carbonless recordation page for recording said inscription, said recordation page comprising (i) a recordation section and (ii) at least first and second opposed recordation attaching sections;

said inscription page being removably attached by said adhesive coating to said privacy section and said at least first and second opposed privacy attaching sections, and said at least first and second opposed privacy attaching sections being removably attached to a corresponding one of said at least first and second opposed recordation attaching sections.

8. A system according to claim 7, wherein said privacy page comprises a plurality of detachable inscription sections and functions to hide said recordation page including said recorded inscription thereon when one of said plurality of detachable inscription sections is detached.

9. A system according to claim 8, wherein any of said plurality of inscription sections is an identification badge.

10. A method of inscribing and securely recording information by means of the system of claim 8, said system comprising an inscription page comprising a plurality of detachable inscription sections, a carbonless privacy page, and a carbonless recordation page, said inscription page, said privacy page, and said recordation page being removably attached, whereby when said inscription page is inscribed, an inscription is transferred to said recordation page, said method comprising:

(a) inscribing one or a plurality of said detachable inscription sections;

(b) detaching said one or a plurality of inscribed detachable inscription sections; and (c) detaching said recordation section from said first recordation attaching section and from said second recordation attaching section so as to provide a record of each inscription.

11. A method according to claim 10, wherein each of said plurality of detachable sections is an identification badge.

12. A system according to claim 7, wherein said inscription page comprises a plurality of detachable inscription sections.

13. A system of claim 7, wherein said privacy page functions to hide said recordation page including said recorded inscription thereon when one of said plurality of detachable inscription sections is detached.

14. A system according to claim 7, wherein said privacy page has no holes therein.

15. A system according to claim 7, wherein at least one said inscription section is an identification badge.

16. A method of inscribing and securely recording information by means of the system of claim 7, said system comprising an inscription page comprising a plurality of detachable inscription sections, a carbonless privacy page, and a carbonless recordation page, said inscription page, said privacy page, and said recordation page being removably attached, whereby when said inscription page is inscribed, an inscription is transferred to said recordation page, said method comprising:

(a) inscribing one or a plurality of said detachable inscription sections;

(b) detaching said one or a plurality of inscribed detachable inscription sections; and (c) detaching said recordation section from said first recordation attaching section and from said second recordation attaching section so as to provide a record of each inscription.

17. The system of claim 7, wherein said privacy page is an opaque carbonless privacy page.

18. The system of claim 7, wherein said privacy section is opaque.

19. A system according to claim 7, wherein said privacy page consists of (i) said privacy section and (ii) said first and second opposed privacy attaching sections.

* * * * *